US008905600B2

(12) United States Patent
Sun et al.

(10) Patent No.: US 8,905,600 B2
(45) Date of Patent: Dec. 9, 2014

(54) LIGHT-EMITTING DIODE LAMP AND METHOD OF MAKING

(75) Inventors: Chih-Hsuan Sun, Kaohsiung (TW); Hsiao-Wen Lee, Hsinchu (TW)

(73) Assignee: TSMC Solid State Lighting Ltd., Hsin-Chu (TW)

( * ) Notice: Subject to any disclaimer, the term of this patent is extended or adjusted under 35 U.S.C. 154(b) by 186 days.

(21) Appl. No.: 13/273,850

(22) Filed: Oct. 14, 2011

(65) Prior Publication Data

US 2012/0106140 A1 May 3, 2012

Related U.S. Application Data

(60) Provisional application No. 61/409,671, filed on Nov. 3, 2011.

(51) Int. Cl.

| | |
|---|---|
| ***F21V 29/02*** | (2006.01) |
| ***F21K 99/00*** | (2010.01) |
| *F21V 29/00* | (2006.01) |
| *F21V 3/00* | (2006.01) |
| *F21Y 101/02* | (2006.01) |

(52) U.S. Cl.

CPC ..... *F21V 29/2293* (2013.01); *F21V 3/00* (2013.01); *F21Y 2101/02* (2013.01); *F21K 9/90* (2013.01); *F21V 29/2231* (2013.01); *F21K 9/135* (2013.01)

USPC ..... 362/373; 362/650

(58) Field of Classification Search

CPC ... F21V 29/004; F21V 29/2293; F21V 29/02; F21V 29/2206; F21V 29/225; F21V 29/2231; F21V 15/001; H01L 33/64

USPC ..... 362/362–375, 650

See application file for complete search history.

(56) References Cited

U.S. PATENT DOCUMENTS

| | | | | |
|---|---|---|---|---|
| 7,144,135 | B2 | 12/2006 | Martin et al. | |
| 2007/0200133 | A1* | 8/2007 | Hashimoto et al. | 257/100 |
| 2008/0157112 | A1* | 7/2008 | He et al. | 257/98 |
| 2008/0210966 | A1* | 9/2008 | Sakamoto et al. | 257/98 |
| 2010/0091487 | A1* | 4/2010 | Shin | 362/235 |
| 2011/0051430 | A1* | 3/2011 | Chen | 362/373 |

OTHER PUBLICATIONS

Lingard, R. D., et al., "Performance of Incandescent A-Type and Decorative Lamps and LED Replacements", CALiPER Benchmark Report, Nov. 2008, pp. 1-16.

ANSI C78.20-2003, Revisions of ANSI C78.20-1995, American National Standard fro Electric Lamps—A, G, PS, and Similar Shapes with E26 Medium Screw Bases, American National Standard Lighting Group, Rosslyn, VA, pp. 1-42.

* cited by examiner

*Primary Examiner* — Anh Mai
*Assistant Examiner* — Nathaniel Lee
(74) *Attorney, Agent, or Firm* — Haynes and Boone, LLP

(57) ABSTRACT

A Light-Emitting Diode (LED) lamp includes a heat sink with a number of passive air flow ducts defined at least partially by fins of the heat sink and a cover plate over the fins. The heat sink includes a body with a cavity, a number of fins radiating outwards from the body, and a cover plate covering the fins. Each passive air flow duct includes top and bottom openings for air flow.

19 Claims, 10 Drawing Sheets

View B

View A

View D-D'

View C-C'

View F-F'

View E-E'

LIGHT-EMITTING DIODE LAMP AND METHOD OF MAKING

CROSS-REFERENCE TO RELATED APPLICATIONS

The present application claims priority of U.S. Provisional Patent Application Ser. No. 61/409,671, filed on Nov. 3, 2010, which is incorporated herein by reference in its entirety.

TECHNICAL FIELD

The present disclosure relates generally to a light source, and more particularly, to a Light-Emitting Diode (LED) lamp.

BACKGROUND

A Light-Emitting Diode (LED), as used herein, is a semiconductor light source for generating light at a specified wavelength or a range of wavelengths. LEDs are traditionally used for indicator lamps, and are increasingly used for displays and general lighting. An LED emits light when a voltage is applied across a p-n junction formed by oppositely doping semiconductor compound layers. Different wavelengths of light can be generated using different materials by varying the bandgaps of the semiconductor layers and by fabricating an active layer within the p-n junction. Additionally, an optional phosphor material changes the properties of light generated by the LED.

Continued development in LEDs has resulted in light that can cover the visible spectrum and be used as a lighting source. These attributes, coupled with the potentially long service life of solid state devices, enabled a variety of new applications such as replacement lamps to compete with the well entrenched incandescent and fluorescent lamps for general lighting

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 2A and 2B illustrate a vertical section view and a perspective view of portions of an embodiment of the LED lamp, while

DETAILED DESCRIPTION

Figure 1B:
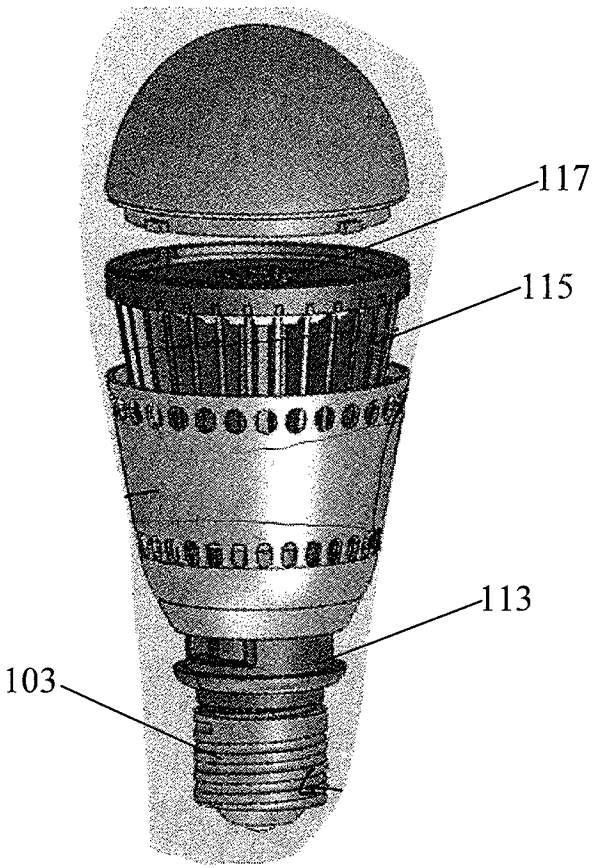
FIGS. 1A and 1B illustrate an exterior view and an exploded diagram view of an embodiment of a light-emitting diode (LED) lamp according to one or more embodiments of the present disclosure.

It is to be understood that the following disclosure provides many different embodiments, or examples, for implementing different features of the invention. Specific examples of components and arrangements are described below to simplify the present disclosure. These are, of course, merely examples and are not intended to be limiting. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Various features may be arbitrarily drawn in different scales for simplicity and clarity.

A Light-Emitting-Diode (LED) lamp is a solid-state lamp that uses LEDs as the source of light. The term "LED light bulb" is also commonly used. As a replacement lamp for incandescent bulbs, an LED lamp should fit in existing light fixtures physically and offer similar lighting quality and aesthetic appeal as the lamp it replaces. As used herein, an LED lamp is a light bulb shaped light source for general lighting that conforms or is compatible to one of American National Standards Institute (ANSI) standards. The A-lamp, for example, A19 according to ANSI C78.20-2003 (which is incorporated by reference herein in its entirety), is the most common general light source having a maximum bulb diameter of 2.375 inches and an Edison screw base having a diameter of 26 millimeters (E26) or 27 millimeters (E27). Because incandescent sources inherently produce warm white light, with correlated color temperature (CCT) values in the range of 2700-3000 K and have high color rendering index (CRI) values, replacement LED lamps have similar design requirements.

Conventional LED lamps available as replacement A-lamps suffer from poor color temperature, low CRI, less than true omni-directional output, and sometimes-poor fit in a light fixture. While LED lamps generally produce a relatively low amount of heat when compared to their counterpart incandescent and/or halogen lights, heat dissipation is still required to prevent burning-up of the LED due to the generated heat. In some solutions, a thermal interface material (TIM) and a large block heat spreader are attached between an LED and the surface of a large heat sink device or a fan is used to move air around the surface of a heat sink. The inventors have noted that the large heat sink is difficult to make within the ANSI size requirement and that the use of a fan not only increases power consumption but also makes noise. Further, as LED lamps are made with increasing power to replace higher wattage lamps, the amount of heat to be removed also increases.

The present disclosure provides embodiments of an LED lamp using a heat sink design that can be made aesthetically pleasing, has sufficient heat removal capacity for a larger wattage lamp replacement, and does not require a fan to actively move air. The heat sink includes a number of passive air flow ducts defined at least partially by fins of the heat sink and a cover plate over the fins. The heat sink includes a body with a cavity, a number of fins radiating outwards, or extending radially, from the body, and a cover plate covering the fins. The cover plate has top and bottom openings for air flow through the passive air flow ducts. In some embodiments, the cover plate is a separate part that is later attached to the heat sink. In other embodiments, the entire heat sink is made out of one material seamlessly for maximum heat conduction. The LED lamp conforms to ANSI light bulb specifications and the fins with the cover plate can be designed for aesthetics. Further, an exterior surface of the cover plate may be designed to be not too hot for human touch during lamp operation by using a material that is thermally insulating compared to the fins. For example, the cover plate may be made of thermal plastic while the fins are metal; or the cover plate may be painted white.

Figure 1A:
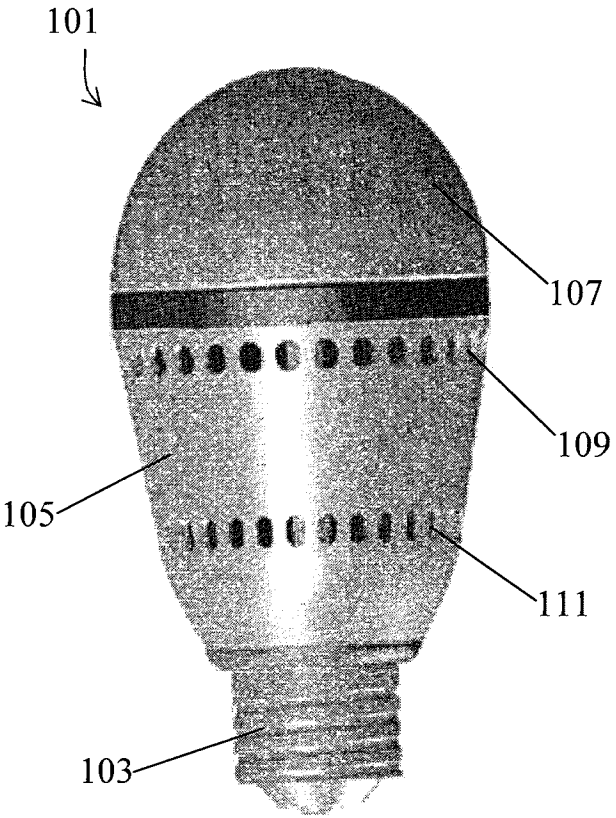

FIG. 1A illustrate an exterior view of an embodiment of an LED lamp 101 according to the present disclosure. From the outside, the LED lamp 101 includes an Edison screw base 103 below a heat sink cover plate 105 and a diffuser 107. The heat sink cover plate 105 has at least a top opening 109 and at least a bottom opening 111 to serve as either entrance or exit for passive airflow.

FIG. 1B is an exploded diagram view of the same LED lamp 101. FIG. 1B further shows the screw base 103 attached to a power supply enclosure 113, which is placed in the heat sink 115. In this view, the cover plate 105 is shown separated from the heat sink 115. On top of the heat sink and thermal-conductively connected to the heat sink is the LED package 117. The LED package 117 includes a number of LEDs packaged on a package substrate. The package substrate has a high thermal conductivity and conducts generated heat during LED operation to the heat sink 115. On top of the heat sink 115 and over the LED package 117 is diffuser 107 which is made of or coated with an optical diffuser. The diffuser 107 connects to the periphery of the LED package 117 and forms an anti-dust enclosure with the LED package 117. The anti-dust enclosure covers the LED package 117 and isolates it from external elements. Dust, air and moisture are known to reduce lifetime of LEDs by reducing the efficiency of phosphor materials and reducing transmittance of various materials in the optical path. Preventing dust, air and moisture from entering the enclosure reduces luminous decay.

Figure 2B:
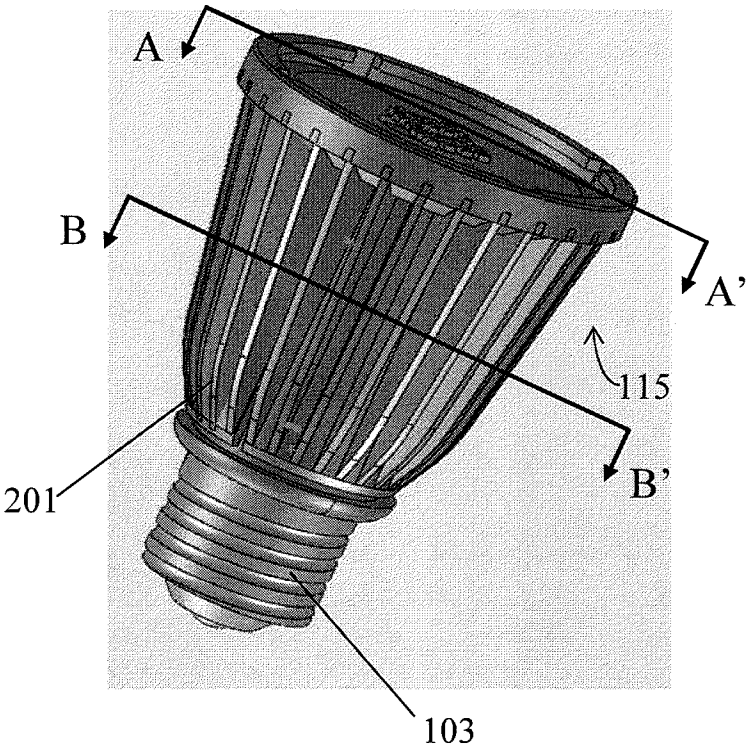
Figure 2A:
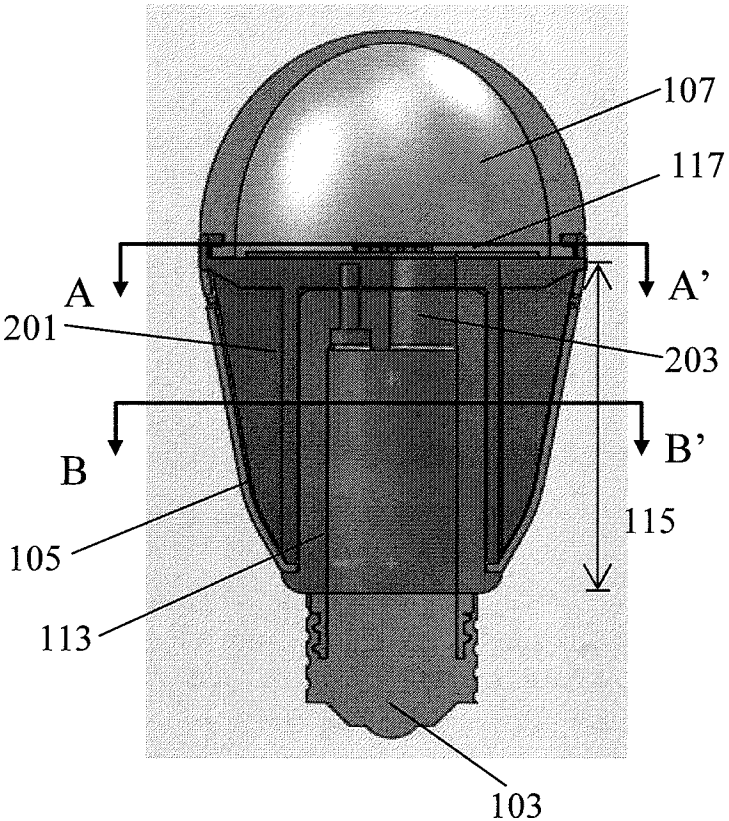

FIG. 2A illustrates a vertical section view of the LED lamp 101 in an assembled state. Horizontal cross sections at lines A-A' and B-B' are shown in FIGS. 3A (View A) and 3B (View B), respectively. The vertical section view of FIG. 2A shows the heat sink 115, the cover 105, fins 201, and a cavity occupied by the power supply enclosure 113. The power supply enclosure 113 includes a connector 203 that gives access from the power supply enclosure 113 to the LED package substrate for electrical connections.

Figure 2C:
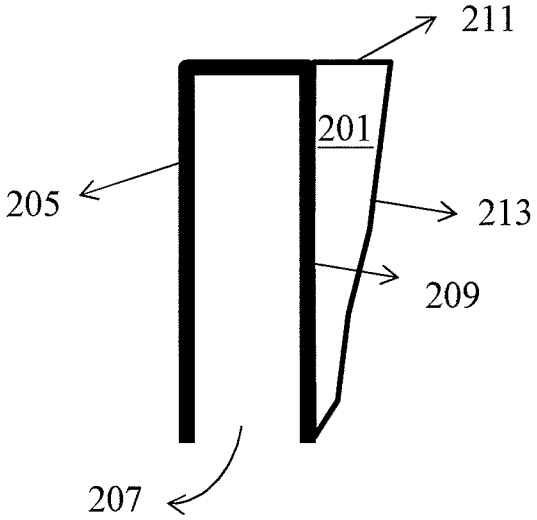
FIG. 2C shows a portion of the embodiments in FIGS. 2A and 2B, according to one or more embodiments of the present disclosure.

FIG. 2B shows a perspective illustration of the heat sink 115 without the cover plate 105. While the cover plate 105 is a part of the heat sink 115 in most embodiments, the cover plate 105 is removed in this Figure to better show the internal features of the heat sink 115. The heat sink 115 includes a number of fins 201 that is made of a same material as the heat sink body. FIG. 2C shows the heat sink body 205 and a fin 201 separately from the rest of the assembly. The fins 201 extend radially from the heat sink body 205 as shown in FIGS. 2B and 2C. The number of fins may be at least 10, more than 20, about 25, or more. Generally, an increasing number of fins increases the surface area which increases cooling. However, more fins are harder to make in one seamless piece with the heat sink body. While metal extrusion processes may support a higher number of fins, the heat conduction may be lower if the fins are attached to the heat sink body in a separate operation through the use of glue, bonding, welding, or mechanical attachment means. Further, thermodynamically speaking, after including a certain number of fins, the marginal increase in surface area caused by an additional fin has a decreased marginal effectiveness in additional heat removal. Thus, an optimum number of fins may be between about 20 and about 30 fins.

Referring to FIG. 2C, each fin 201 has a relatively straight inner edge 209 at the heat sink body 205 and next to the cavity 207. Each fin 201 also has a top edge 211 that is connected to the LED package substrate, which may conduct heat directly to the fins 201. Each fin 201 also has an outer edge 213 connected to the cover plate. This outer edge 213 may be curved, straight, or have more than one sections depending on the aesthetic design of the LED lamp. In some embodiments, each fin 201 may have a bottom edge connected to the cover plate.

The heat sink design promotes passive air flow through passive air flow ducts formed between two fins, the heat sink body, and the cover plate. In these embodiments, the cover plate includes a top opening 109 and a bottom opening 111 for airflow. During LED operation, the LEDs in the LED package have a highest temperature. In the passive air flow ducts, the top edge of the fins around the connection to the LED package is the hottest. If the LED lamp points up, i.e., toward a ceiling, then the air would flow from the bottom opening to the top opening as hot air rises. Hot air would exit the LED lamp through the top opening. If the LED lamp points down, i.e., toward the ground, then the air would flow from the top opening to the bottom opening and exits there because the bottom opening would then be positioned higher than the top opening. Based on testing results, the difference between operating the LED lamp pointing up or down has only a small effect on the LED package temperature, less than about 5 degrees Celsius.

In order to promote heat conduction, the number of junctions in the thermal path is minimized. Thus, the heat sink body and the fins are formed in one piece seamlessly according to various embodiments. The heat sink is made of a material having high thermal conductivity, which may be a thermal plastic, a ceramic, or a metal. Thermal plastics have the advantage of being easier to work with—they can be molded into any desired shape. However, the thermal conductivity is lower than some ceramics and most metals. Thus for the higher wattage LED lamps, thermal plastics may not be able to conduct away enough heat. Ceramic material may be a suitable in some designs. Known ceramic material with high thermal conductivity includes silicon carbide, aluminum nitride, and alumina. While not as easy as to work with as plastics, ceramic material may be pressed into many shapes. However, the resulting heat sink may be brittle and shatters easily. A potential material having very high heat conductivity is metal, for example, copper, aluminum, and nickel. Factors that influence the use of metallic heat sink includes weight of the LED lamp, cost, and ease of processing. The LED lamp weight should be low enough to be supported by all light fixtures. Lower weight also reduces shipping costs and material costs. Metals are not easy to form into a one-piece seamless heat sink. In some embodiments, aluminum or copper is punched into a mold to form the fins and heat sink body. In other embodiments, the heat sink may be die-casted using a mold having one or several pieces. For example, a three-piece mold may be removed easily by pulling away from the heat sink body. In some embodiments, some surfaces of the heat sink may be coated with a powder coating to further increase heat transfer, both through the heat sink and to the air. The powder coating may be a ceramic.

In other embodiments, the fins may be formed in a spiral instead of being straight. In some embodiments, the fins may have holes so that air may flow from one passive airflow duct to another. In other embodiments, the heat sink body may have openings for air flow so that air can also flow from the power supply to the exit opening.

FIG. 3A illustrates a cross section view taken along line A-A', from FIG. 2A or 2B, of an LED lamp at a vertical position right at the LED package 301 and top of the heat sink 115. The LED package 301 directly contacts the top edges of the heat sink fins to allow maximum heat conduction to the heat sink. The LED package includes a number of LEDs 303 packaged on a package substrate 305. While 20 LEDs are shown, the number of LEDs can be a range of numbers determined based on each LED's light emitting ability, which is related to its size, and heat removal capacity of the LED lamp. A typical LED package for an LED lamp may have between about 5 and about 30 LEDs that are individually encapsulated. In some designs where a number of LEDs are encapsulated together, the number of LEDs may be a hundred or more.

An LED includes a light-emitting structure that has two doped layers and a multiple quantum well layer, also referred to as the active layer, between the doped layers. The doped layers are oppositely doped semiconductor layers. In some embodiments, a first doped layer includes an n-type gallium nitride material, and the second doped layer includes a p-type material. In other embodiments, the first doped layer includes a p-type gallium nitride material, and the second doped layer includes an n-type gallium nitride material. The MQW layer includes alternating (or periodic) layers of active material, for example, gallium nitride and indium gallium nitride. For example, in one embodiment, the MQW layer includes ten layers of gallium nitride and ten layers of indium gallium nitride, where an indium gallium nitride layer is formed on a gallium nitride layer, and another gallium nitride layer is formed on the indium gallium nitride layer, and so on and so forth.

The doped layers and the MQW layer are all formed by epitaxial growth processes on a growth substrate, which may be made of silicon, silicon carbide, gallium nitride, or sapphire. After the completion of the epitaxial growth processes, a p-n junction (or a p-n diode) is essentially formed. When an electrical voltage is applied between the doped layers, an electrical current flows through the light-emitting structure, and the MQW layer emits light. The color of the light emitted by the MQW layer is associated with the wavelength of the emitted radiation, which may be tuned by varying the composition and structure of the materials that make up the MQW layer. The light-emitting structure may optionally include additional layers such as a buffer layer between the growth substrate and the first doped layer, a reflective layer, and an ohmic contact layer. A suitable buffer layer may be made of an undoped material of the first doped layer or other similar material. A light-reflecting layer may be a metal, such as aluminum, copper, titanium, silver, silver, alloys of these, or combinations thereof. An ohmic contact layer may be an indium tin oxide (ITO) layer. The light reflecting layer and ohmic contact layer may be formed by a physical vapor deposition (PVD) process or a chemical vapor deposition (CVD) or other deposition processes.

LEDs 303 are attached to a package substrate 305 and phosphor material coating over the LED or dispersed in encapsulant or lens material. As shown in FIG. 3A, each LED has a phosphor material coating and lens. An LED package substrate is a highly thermal conductive material that may be a lead frame, ceramic, metal core printed circuit board (MCPCB) or an alumina board. The LEDs may be electrically connected to circuitry on the package substrate in a number of ways. One conventional connection method involves attaching a growth substrate side of the LED to the package substrate, and forming metal electrode pads that are connected to the p-type semiconductor layer and the n-type semiconductor layer in a light-emitting structure on the die, and then bond wiring from the metal electrode pads to contact pads on the package substrate. Another conventional connection method involves inverting the LED die and using solder bumps to connect the electrode pads on the light-emitting structure directly to the package substrate. The light from the LED is then directed through the growth substrate. Yet another conventional connection method involves using hybrid connectors. One semiconductor layer, for example the p-type layer, may be wired bonded from a metal electrode pad to a contact pad on the package substrate while the other layer (n-type layer) may be soldered to a contact pad on the package substrate. The LED lamp of the present disclosure may have any of these types of connections.

Figure 3B:
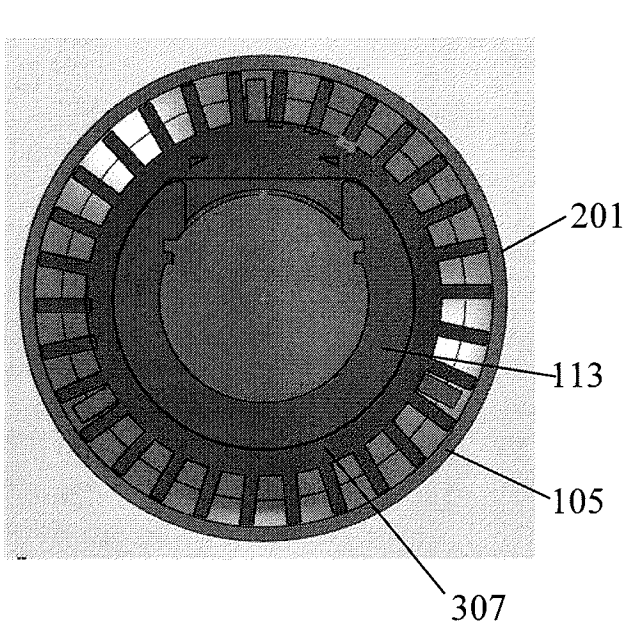
FIGS. 3A and 3B illustrate cross section views of an LED lamp at different vertical positions according to various embodiments the present disclosure.
Figure 3A:
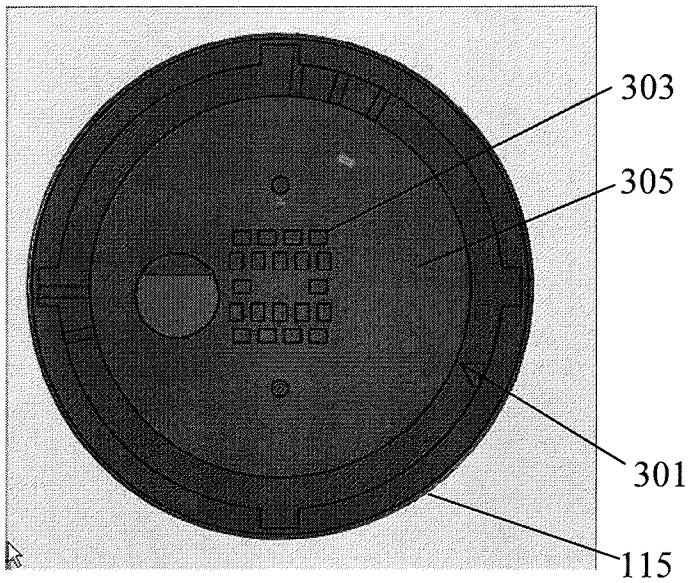

FIG. 3B illustrates a cross section view taken along line B-B', from FIG. 2A, of the LED lamp 101 at a different vertical position. From outside in, this cross section shows the heat sink cover plate 105, fins 201, the heat sink body 307, and the power supply enclosure 113 inside a cavity of the heat sink. Note that the cavity cross-section as shown is not a circle. The power supply enclosure 13 is prevented from rotating inside the cavity by the shape. Other ways to secure the power supply enclosure 113 may be used.

The power supply enclosure 113 holds a power supply. Because LEDs use direct current (DC) electrical power, LED lamps also include internal circuits to convert from standard AC voltage to DC voltage in order to operate. The power supply may additionally include circuitry for controlling the light output. Example functions include light intensity (dimming), color temperature, or a bypass switch to direct current around a failed component to a backup component. The conversion from AC voltage to DC voltage generates some heat that also needs to be removed from the power supply. The power supply enclosure 113 electrically isolates the heat sink from the power supply, so electricity does not conduct through an exterior surface of the LED lamp. Thus the power supply enclosure 113 material is usually a plastic material, epoxy, or resin that does not conduct electricity. However, because the power supply generates heat, a thermal path to prevent heat damage is provided as shown in FIG. 4.

Figure 4:
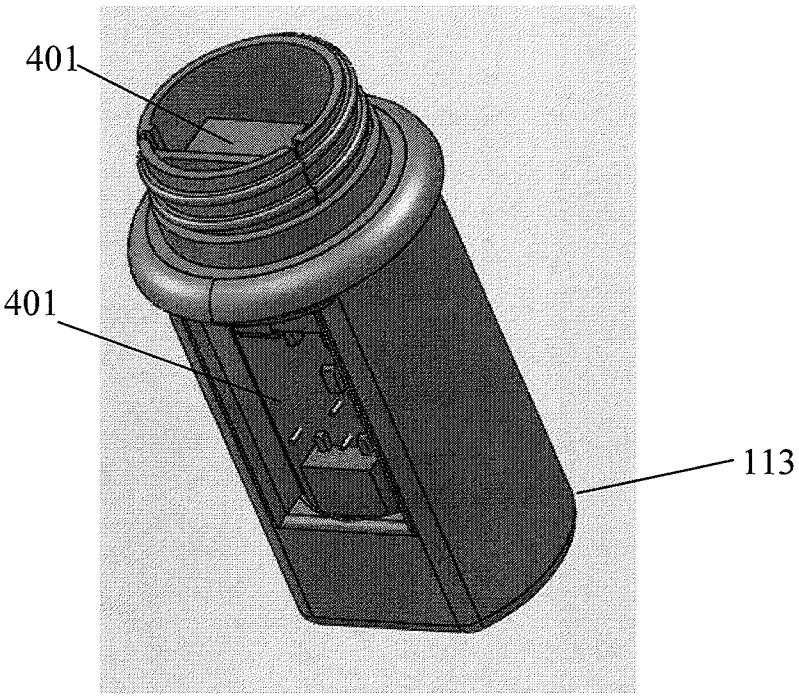
FIG. 4 illustrates a perspective view of a power supply enclosure and power supply of the LED lamp according to various embodiments of the present disclosure.

FIG. 4 illustrates a perspective view of a power supply enclosure and power supply of the LED lamp according to various embodiments of the present disclosure. The power supply 401 is inserted into the power supply enclosure 113, secured, and electrically connected to the LED package through connector 203 from FIG. 2A. The power supply enclosure 113 as shown as an opening cut out at one side and a portion of the power supply 401 is exposed to the heat sink through it. In one embodiment, a thermally conductive material is applied between the power supply and the heat sink to promote heat conduction between the two components. The thermal conductive material may be heat-conductive glue. In other embodiments, heat may be removed from the power supply by including at least a portion of the power supply in one or more passive air flow duct so that the air also flows past the power supply. In still other embodiments, the opening in the power supply enclosure 113 may be formed such that it is a portion of a passive air flow duct. In that case an additional opening for air flow is created around the Edison screw base to allow air flow into and out of the power supply enclosure.

Figure 5B:
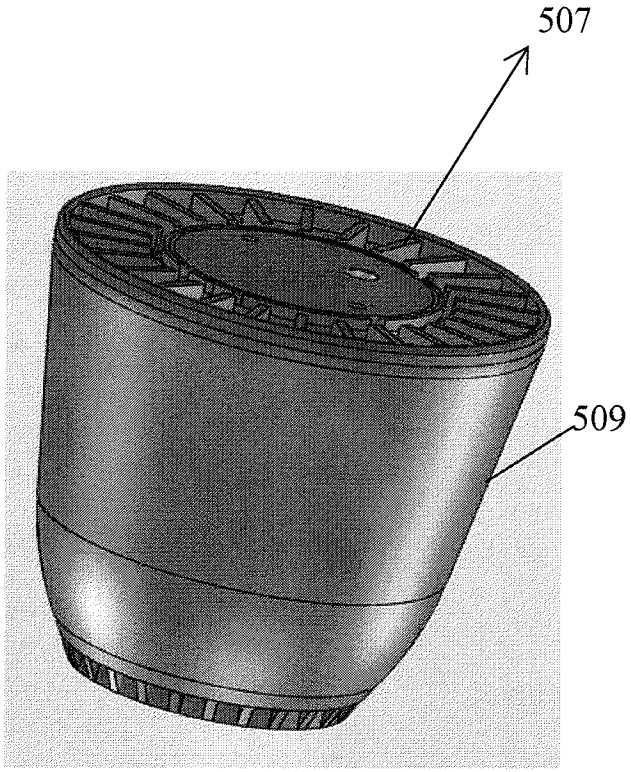
FIGS. 5A and 5B illustrate a vertical section view and a perspective view of portions of a seamless heat sink embodiment of the LED lamp according to one or more embodiments of the present disclosure.
Figure 5A:
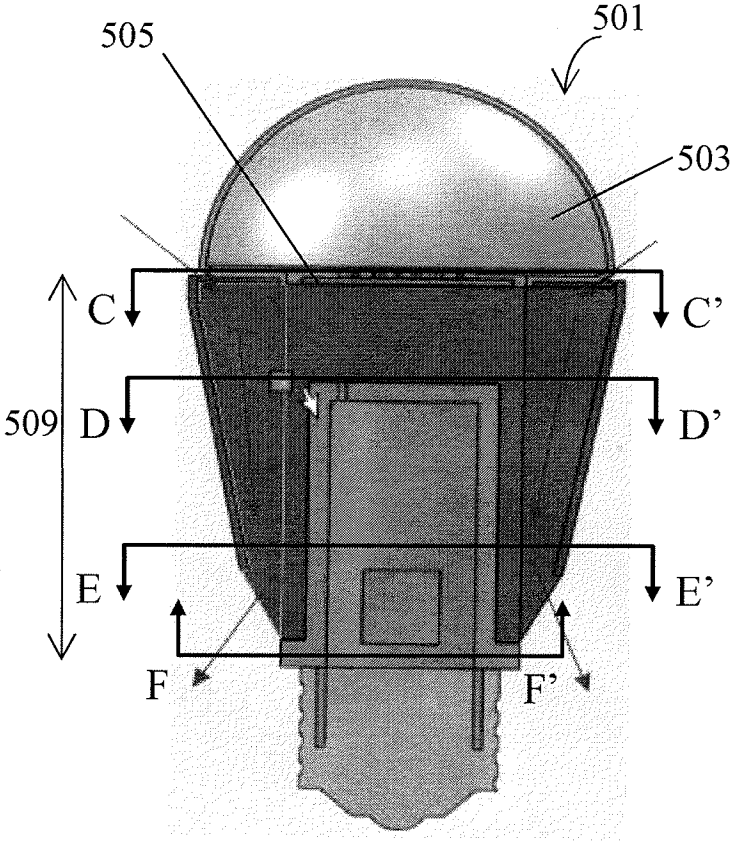

In another aspect, the heat sink in some embodiments of the present disclosure involves a heat sink cover plate that is formed in one-piece with the rest of the heat sink, namely the heat sink body and fins. FIGS. 5A and 5B illustrate a vertical section view and a perspective view of portions of a seamless heat sink embodiment of the LED lamp according to the present disclosure. Various cross-section views of the seamless heat sink embodiment are exemplarily shown in FIGS. 6A-6D. This seamless heat sink embodiment has a minimum number of thermal junctions and thereby maximizes heat removal. The following discussion focuses on differences between LED lamp embodiments of FIGS. 5A-6D and the embodiments of FIGS. 2A-4. Similar details are omitted or referenced to other parts of the present disclosure.

FIG. 5A illustrates a vertical section view of the heat sink and screw base of LED lamp 501 with a complete diffuser 503 according to the present disclosure. Horizontal cross sections at lines C-C', D-D', E-E', and F-F' are shown in FIGS. 6A to 6D, respectively. One feature of this LED lamp is that the top opening of the passive air duct is formed by the top edges of fins 507. The surface of the LED package 505 is smaller relative to the heat sink 509 than other embodiments such that the anti-dust enclosure formed has a smaller bottom. A small gap between the top of the fins 507 and the bottom of diffuser 503 remains to allow airflow. As shown in FIG. 5B, this design results in a smooth exterior surface (cover plate) for the heat sink 509, which may be more aesthetically appealing.

Figure 6B:
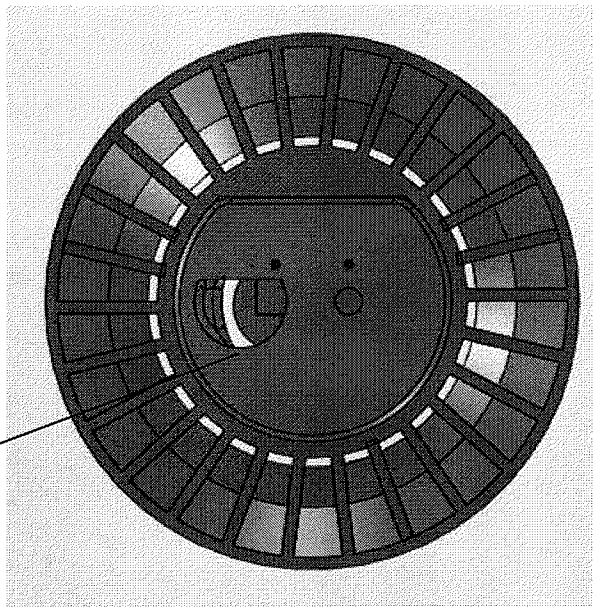
FIGS. 6A to 6D illustrate cross section views of a heat sink at different vertical positions and view points according to various embodiments of the present disclosure.
Figure 6A:
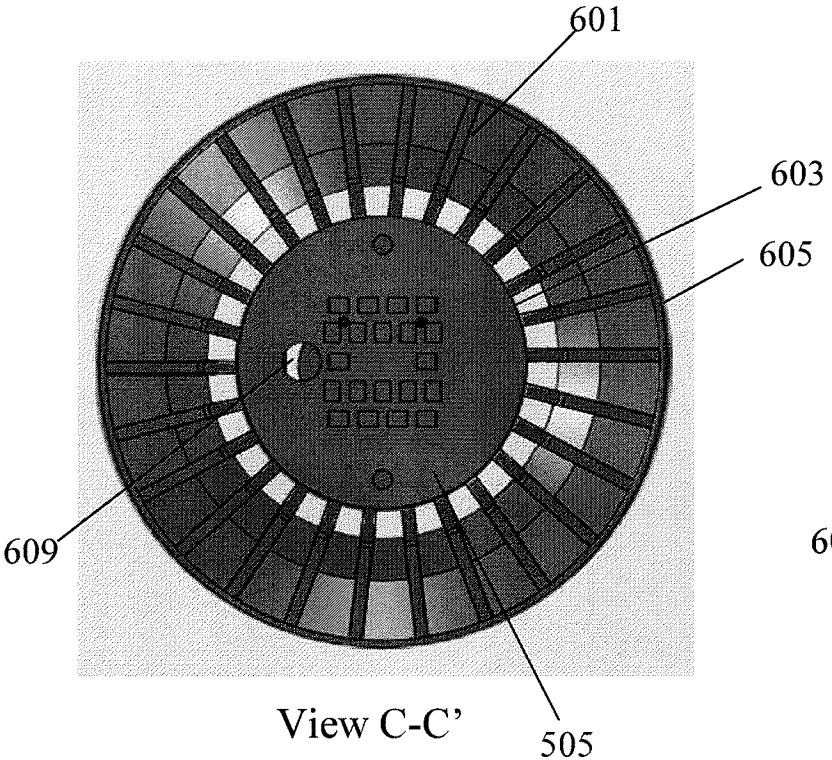

FIG. 6A illustrates a cross section view of the heat sink 509 from FIG. 5A along line C-C', right above the LED package. The top edges 601 of the fins radiate from a heat sink body 603 to the cover plate 605. In the center is the LED package 505, which is described in above and details are not repeated here. FIG. 6B illustrates a cross section view of the heat sink 509 from FIG. 5A along line D-D', which is right above the top of the power supply enclosure 607, which is not shown in FIG. 6A because it is covered by the LED package 505. Openings in a top of the power supply enclosure allow electrical connections to be made with the LED package of FIG. 6A. In some embodiments, the electrical connection is made to a bottom side of the LED package 505. In other embodiments, the electrical connection is made to a top side of the LED package 505 by routing wires through openings such as opening 609 in the LED package substrate. Note that the diameter of the heat sink reduces slightly between FIGS. 6A and 6B based on an exterior profile design.

Figure 6D:
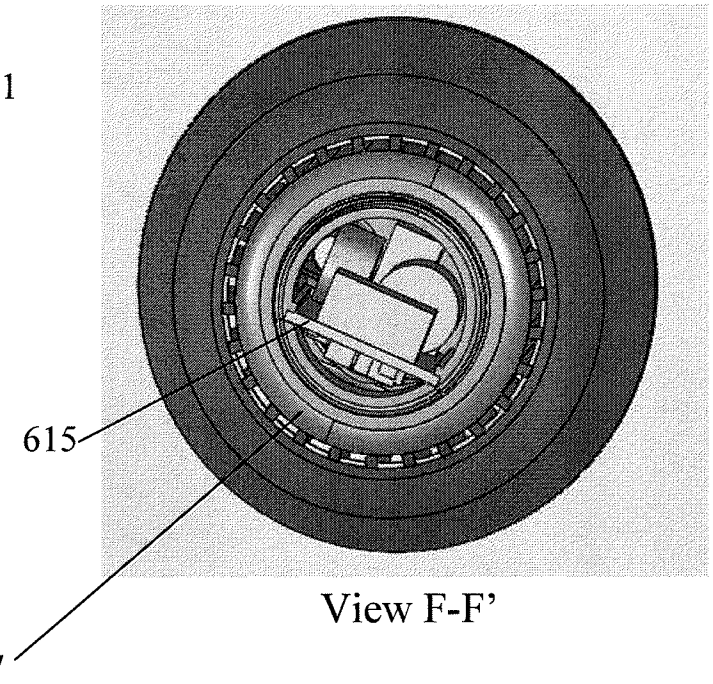
Figure 6C:
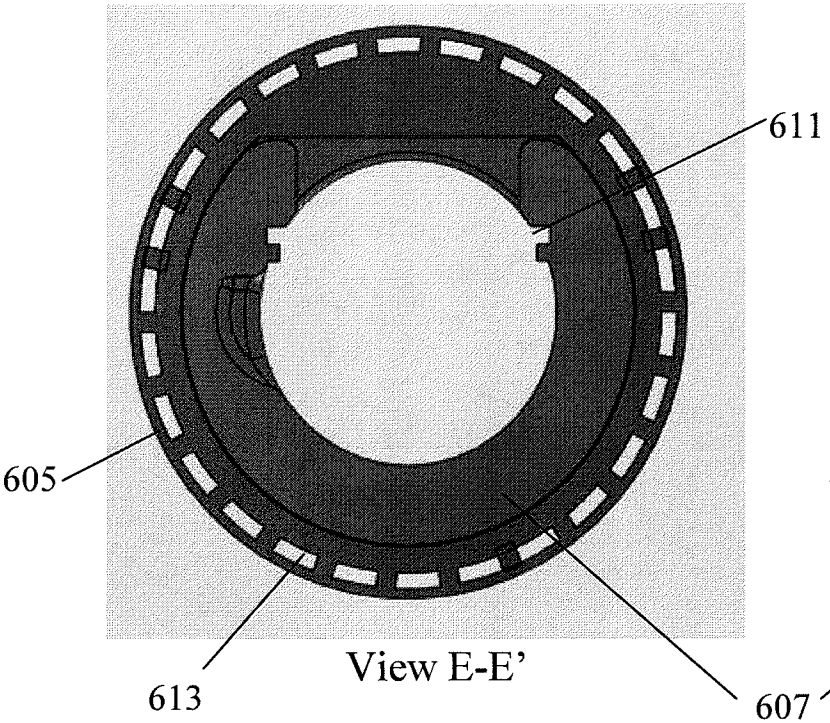

FIG. 6C illustrates a cross section view of the heat sink 509 from FIG. 5A along line E-E', at a mid section of the power supply enclosure 607. Bottom openings 613 for the passive air flow ducts are visible in this cross section. In this heat sink design, the bottom openings 613 are formed by a bottom edge of the fins that are not covered by the cover plate 605. The power supply enclosure 607 includes notches 611 for securing the power supply so that it would not rotate within the enclosure 607. FIG. 6D illustrates a cross section view of the heat sink with a power supply enclosure 607 and power supply 615 from a bottom up perspective.

The heat sink 509 of the embodiments shown in FIGS. 5A-6D is formed out of a single metal material in one seamless piece. The heat sink 509 may be made by die-casting. A molten metal material is forced into mold cavities to form dies. The mold is first sprayed with lubricant to ensure successful removal. The lubricant also helps to control temperature of the die. Molten metal is then shot into the die under very high pressure at greater than 10 MPa (1,500 psi). Once the die is filled the pressure is maintained until the casting has solidified as the molten metal cools. The die is then opened and one or more casted heat sink is removed. There may be additional portions attached to heat sink called the scrap, which is separated from the heat sink. This may be done by hand or by sawing or by using a power press or hydraulic press.

Another way to form the heat sink is by forging the metal into a heat sink shape by press forging or hammer forging and can involve hot or cold forging depending on the heat sink material. In press forging, continuous pressure is applied to a work piece that deforms the work piece into a mold. In hammer forging, an anvil is dropped that applies instant pressure to a work piece. A heat sink 509 may be formed in one piece seamlessly by using any of these processes.

Figure 7:
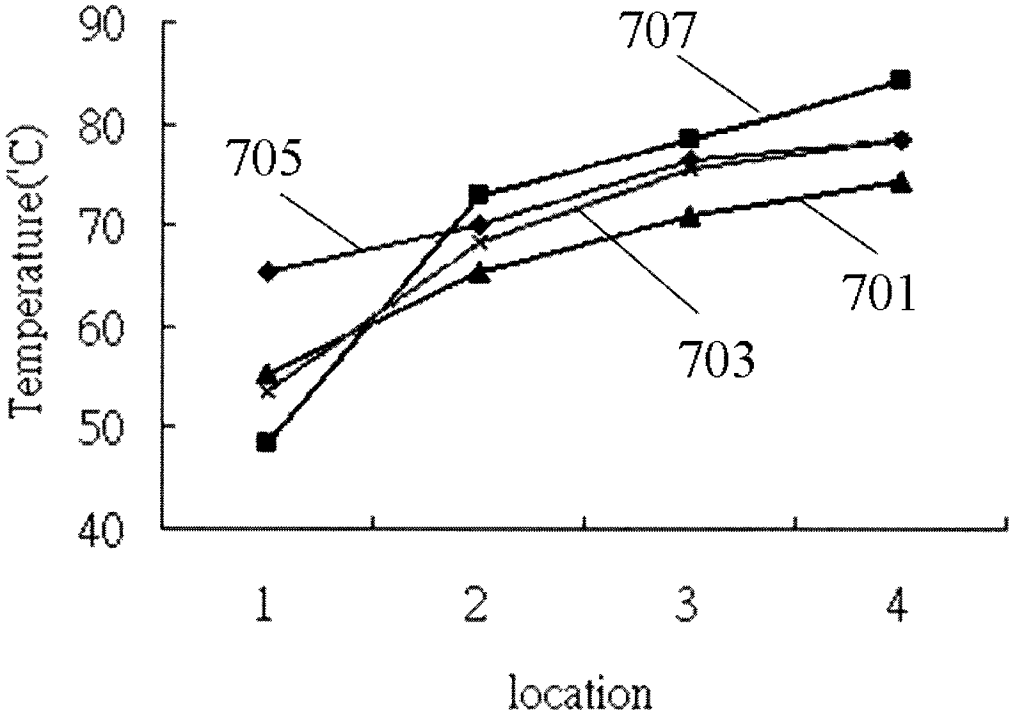
FIG. 7 is a plot of various temperatures measured at different points on two LED lamps with heat sinks in accordance with some embodiments of the present disclosure and two comparison LED lamps.

Two heat sinks of the seamless one-piece design (FIGS. 5A-6D) was tested against commercially available LED lamps with the same or similar wattage specification. The results are shown in FIG. 7. Line 701 (triangle) represent a first heat sink design of FIGS. 5A-6D; line 703 (cross) represents a second heat sink design of FIGS. 5A-6D where the cover plate is painted; line 705 (diamond) represents a first commercially available LED lamp; and, line 707 (square) represents a second commercially available LED lamp. Both of the commercially available LED lamps have heat sinks that are not covered, with a number of exposed fins. Temperature was measured at an outside edge of the respective heat sink next to the top opening (1), at a wire solder into the LED package (2), at the center of the package substrate (3), and under an LED at its attachment to the LED package substrate (4). The results in FIG. 7 show that the heat sinks in accordance with embodiments of FIGS. 5A-6D have similar temperature results to the commercially available LED lamps.

Figure 8:
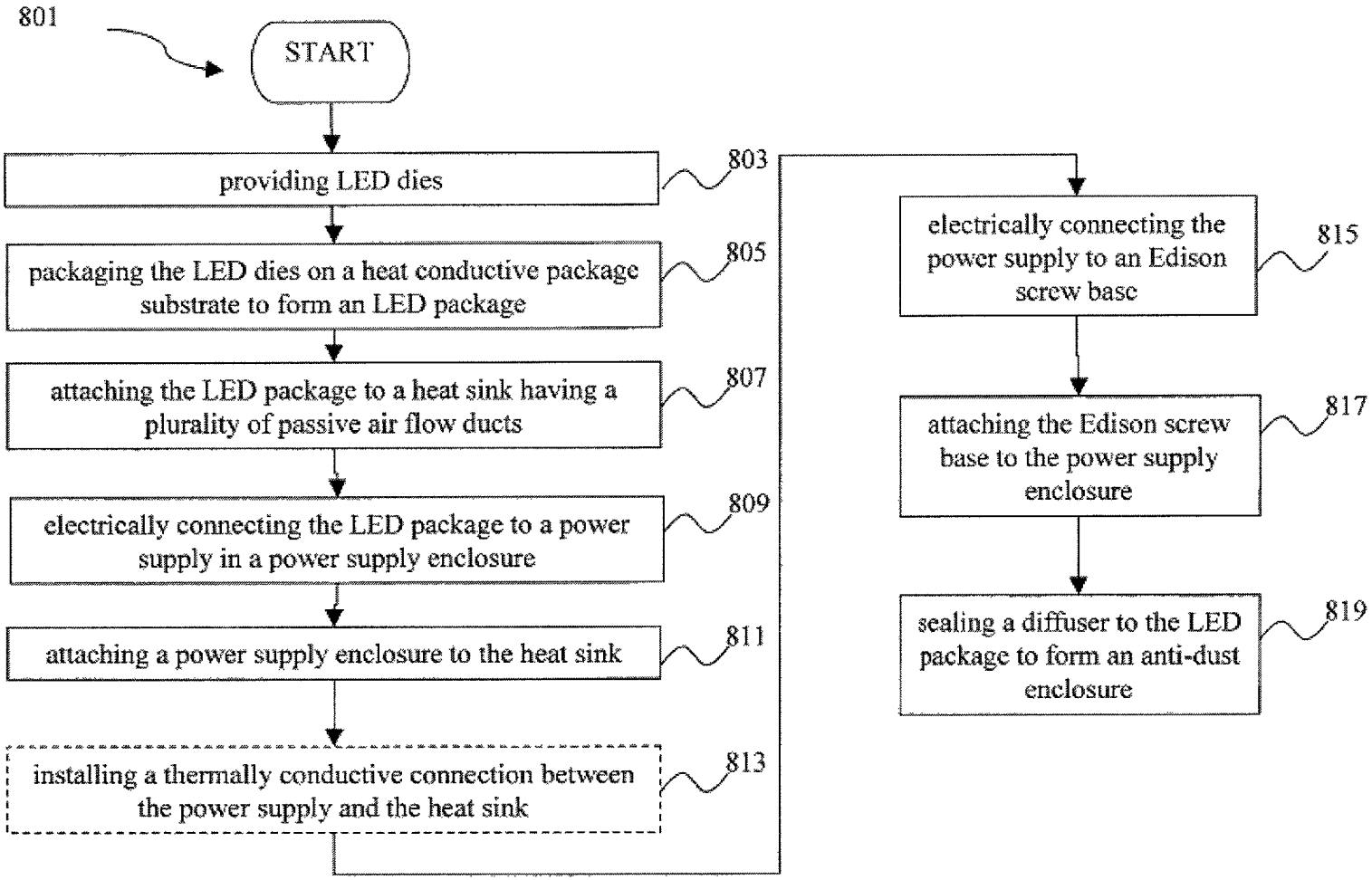
FIG. 8 illustrates a flowchart for fabricating an LED lamp according to various embodiments of the present disclosure.

The foregoing description discusses various features of an LED lamp with a heat sink having passive air flow ducts. FIG. 8 illustrates a flowchart for fabricating an LED lamp according to various embodiments of the present disclosure. The process flow 801 starts with providing a number of LED dies in operation 803. The LED dies are formed on growth substrates as discussed above. In operation 805, the LED dies are packaged on a heat conductive package substrate to form an LED package. Usually, the packaging includes attaching or soldering the LED dies to the package substrate, forming electrical connections between the LED dies and to external terminals, forming additional optical components such as lens, encapsulant, and reflectors over or around the LED dies.

In operation 807, the LED package is attached to a heat sink having a number of passive air ducts. The heat sink may be formed using various methods as described above. The LED package is then electrically connected to a power supply that is in a power supply enclosure in operation 809. Most commonly, wires are soldered on terminals on the LED package and on the power supply.

Before or after electrically connecting the LED package and the power supply, the power supply enclosure is attached to the heat sink in operation 811. The power supply enclosure containing the power supply may be simply inserted into the heat sink. The power supply enclosure may be secured by using tabs or other fasteners, or be glued to the heat sink. In operation 813, a thermal conductive connection between the power supply and the heat sink is installed. In some embodiments as discussed above, the thermally conductive connection is made by connecting the power supply to the heat sink through an opening in the power supply enclosure using a heat conductive glue. In other embodiments, convective cooling is used to remove heat from the power supply by allowing air to flow through the power supply enclosure to one or more passive air flow ducts.

In operation 815, the power supply is electrically connected to an Edison screw base or any other standard light bulb connector (e.g., a bayonet connector). The connection may be made through soldering, welding, mechanical fastening, or other known methods. Then the Edison screw base is attached to the power supply enclosure in operation 817. Because the heat sink is often made of an electrically conductive material such as a metal, care is taken to isolate the electrical path from the heat sink.

In operation 819, a diffuser is sealed against the LED package to form an anti-dust enclosure. This operation may be formed at a time after access to a top surface of the LED package is no longer necessary. If the LED package terminals are on a back side of the LED package substrate, then the anti-dust enclosure may be formed after the LED dies are packaged. The sealing may include simply gluing the diffuser to the LED package, or additionally mechanically fasten the diffuser against the LED package.

These operations describe certain embodiments of fabricating LED lamps in accordance with the present disclosure. The heat sink of the present disclosure provides adequate cooling by passive air flow without using a fan to actively move air. Having a smooth exterior surface, the LED lamp appearance may be aesthetically designed to appeal to consumers.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. It is understood, however, that these advantages are not meant to be limiting, and that other embodiments may offer other advantages. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A Light-Emitting Diode (LED) lamp, comprising:

an LED package;

a diffuser mounted over the LED package that forming an anti-dust enclosure with the LED package;

a heat sink directly attached to the LED package to form a conductive thermal path, wherein the heat sink comprises a body having a cavity, a plurality of fins radiating from the body, and a cover plate over the plurality of fins, wherein the plurality of fins and the cover plate form sides of a plurality of passive air flow ducts each having only a top opening and a bottom opening to an outside of the LED lamp, wherein the top opening and the bottom opening are aligned for each of the air flow ducts, and wherein the fins include holes configured to facilitate thermal communication between the air flow ducts;

a power supply enclosure within the cavity of the heat sink;

a power supply electrically coupled to the LED package and disposed inside the power supply enclosure; and a screw base attached to the power supply enclosure and electrically connected to the power supply for fixing the LED lamp to a lighting fixture; and wherein the body of the heat sink includes one or more openings so as to facilitate airflow from the power supply to one of the top and bottom openings.

2. The LED lamp of claim 1, wherein the heat sink is a fan-less heat sink.

3. The LED lamp of claim 1, wherein the body and the fins of the heat sink comprise a thermal plastic, ceramic, or a metal, and wherein the metal is at least one selected from the group consisting of copper, nickel, aluminum, and alloys thereof.

4. The LED lamp of claim 3, wherein the metal is coated with a ceramic powder.

5. The LED lamp of claim 1, wherein the cover plate of the heat sink comprises a material different from the body and the fins of the heat sink.

6. The LED lamp of claim 5, wherein the cover plate is painted.

7. The LED lamp of claim 6, wherein the cover plate is white.

8. The LED lamp of claim 1, wherein the power supply enclosure is irrotationally engaged with the heat sink.

9. The LED lamp of claim 1, wherein the LED package comprises an LED die on a package substrate with high thermal conductivity.

10. The LED lamp of claim 9, wherein the package substrate with high thermal conductivity comprises a metal core printed circuit board (MCPCB), a silicon substrate, a ceramic substrate, or a metal substrate.

11. The LED lamp of claim 1, wherein the cover plate reaches a maximum temperature of less than 45 degrees Celsius during operation of the LED lamp.

12. The LED lamp of claim 1, wherein the plurality of fins includes at least 10 fins.

13. The LED lamp of claim 1, wherein a thermal glue connects the power supply and the heat sink.

14. The LED lamp of claim 1, wherein the anti-dust enclosure is hermetically sealed.

15. A Light-Emitting Diode (LED) lamp, comprising:

an LED package;

a diffuser mounted over the LED package and forming an anti-dust enclosure with the LED package;

a seamless heat sink directly attached to the LED package to form a conductive thermal path, wherein the heat sink comprises a body portion, a plurality of fins portions extending radially from the body portion, and a cover plate portion over the plurality of fin portions, and wherein the heat sink further defines therein a plurality of passive air flow ducts, wherein walls of each of the passive air flow ducts include a strip of the body portion, two adjacent fins, and a portion of the cover plate, and wherein the cover plate portion includes a plurality of first openings and a plurality of second openings, and wherein each of the passive air flow ducts is aligned with a respective first opening and a respective second opening, and wherein the fin portions each include a respective hole therein;

a power supply enclosure within the cavity of the heat sink;

a power supply electrically coupled to the LED package and disposed inside the power supply enclosure; and, a screw base attached to the power supply enclosure and electrically connected to the power supply for fixing the LED lamp to a lighting fixture;

wherein the body portion of the heat sink includes one or more openings so as to facilitate airflow from the power supply to one of the first and second openings.

16. The LED lamp of claim 15, wherein the heat sink is a die cast product of a single material.

17. The LED lamp of claim 16, wherein the single material is copper, aluminum, ceramic, or thermal plastic.

18. A method of making a Light-Emitting Diode (LED) lamp, said method comprising:

providing LED dies;

packaging the LED dies on a heat conductive package substrate to form an LED package; attaching the LED package to a heat sink having a plurality of passive air flow ducts, wherein each of the passive air flow ducts is defined by a body of the heat sink, fins protruding from a body of the heat sink, the fins each including a respective hole therein, and a cover plate having a plurality of first openings and a plurality of second openings disposed over the fins, and wherein each of the passive air flow ducts is aligned with a respective one of the first openings and a respective one of the second openings;

electrically connecting the LED package to a power supply in a power supply enclosure, wherein the body of the heat sink includes one or more openings that facilitate airflow from the power supply to one of the first and second openings;

attaching the power supply enclosure to the heat sink;

installing a thermal conductive connection between the power supply and the heat sink;

electrically connecting the power supply to an Edison screw base;

attaching the Edison screw base to the power supply enclosure; and sealing a diffuser to the LED package to form an anti-dust enclosure.

19. The method of claim 18, wherein the plurality of passive air flow ducts includes 20 or more passive air flow ducts.

* * * * *